US007294094B1

(12) United States Patent
Howle

(10) Patent No.: US 7,294,094 B1
(45) Date of Patent: Nov. 13, 2007

(54) PARTIAL WEIGHT BEARING SUSPENSION WALKER

(76) Inventor: Edward Samuel Howle, 403 Presque Isle La., Chapel Hill, NC (US) 27514

( * ) Notice: Subject to any disclaimer, the term of this patent is extended or adjusted under 35 U.S.C. 154(b) by 142 days.

(21) Appl. No.: 11/109,601

(22) Filed: Apr. 19, 2005

Related U.S. Application Data

(60) Provisional application No. 60/574,420, filed on May 26, 2004.

(51) Int. Cl.
*A63B 21/00* (2006.01)

(52) U.S. Cl. ..... 482/69; 135/67

(58) Field of Classification Search ..... 482/66, 482/67, 69; 135/67; 52/111; 182/3; 180/65.1
See application file for complete search history.

(56) References Cited

U.S. PATENT DOCUMENTS 2,734,554 A * 2/1956 Ries ..... 482/66
4,995,412 A * 2/1991 Hirn et al. ..... 135/67
5,143,171 A * 9/1992 Glynn et al. ..... 182/3
5,476,432 A * 12/1995 Dickens ..... 482/67
5,502,851 A 4/1996 Costello
5,526,893 A * 6/1996 Higer ..... 180/65.1
5,569,129 A 10/1996 Seif-Naraghi
5,603,677 A 2/1997 Sollo
5,662,560 A 9/1997 Svendsen et al.
5,694,720 A * 12/1997 Walcher et al. ..... 52/111
5,695,432 A 12/1997 Soderlund
5,704,881 A * 1/1998 Dudley ..... 482/69
6,302,828 B1 * 10/2001 Martin et al. ..... 482/69
6,578,594 B1 * 6/2003 Bowen et al. ..... 135/67
6,689,075 B2 2/2004 West

* cited by examiner

*Primary Examiner*—Jerome Donnelly

(57) ABSTRACT

A lightweight, foldable device for the partial weight bearing during walking and gait training is provided. The lightweight, partial weight bearing suspension walker is made from two frames that are pivotally attached and can be folded at the pivot point for storage or transport. The apparatus can be adjusted to fit over wide treadmills or wheelchairs and through narrow doors. The apparatus includes two fail-safe lift and support devices to insure patient safety in case of unintentional release by the operator.

5 Claims, 5 Drawing Sheets

PARTIAL WEIGHT BEARING SUSPENSION WALKER

CROSS REFERENCE TO RELATED APPLICATIONS

This application is entitled to the benefit and filing date of Provisional Patent Application 60/574,420 filed May 26, 2004. Applicant claims priority to Provisional Patent Application 60/574,420 filed May 26, 2005 pursuant to 35 USC paragraph 119e.

STATEMENT REGARDING FEDERALLY SPONSORED RESEARCH OR DEVELOPMENT

Not Applicable

BACKGROUND OF THE INVENTION

1. Field of the Invention

The present invention relates to a device for gait training for a walking impaired patient. More specifically the instant invention relates to a lightweight, foldable device that can partially support the weight of a patient while walking and can be adjusted wide enough to fit over treadmills or wheelchairs and can be adjusted narrow enough to fit through standard doorways.

2. Discussion of Related Art

Partial weight bearing gate trainers or unweighting systems are used by medical personnel during physical therapy to improve the mobility of the patient to regain strength and range of motion. These units are generally used over treadmills or on flat surfaces in a medical office. Most of these units use a system of ropes or webbing combined with a harness to lift the patient and lower the amount of weight the patient places upon their legs. The patient can then walk on a treadmill with their weight being partially relieved by the device allowing earlier physical therapy during rehabilitation. These units are most often used in large institutional settings where a dedicated space is available to operate and store the unit.

Current units are often large, heavy pieces of equipment designed for institutional use in large medical facilities. The devices are normally used by patients while walking on a treadmill since the weight and the associated rolling friction of the devices makes them difficult to use on a smooth floor. The units that are more mobile still require an assistant to help the unit roll since the weight of the unit plus the patient's weight make it difficult to roll unaided. The need to constantly guide and assist the patient slows the necessary regaining of the sense of balance for the patient.

Those prior art units are difficult to transport and require the complete disassembly of the equipment and transport by truck or van. Moving a unit often requires two or three people to disassemble and carry the parts to the truck and reassemble them at the next facility. Many units are necessarily wide to insure fitting over a treadmill or wheelchair but are often too wide to fit through most standard doorways.

Today many rehabilitation facilities are much smaller in size and have the need of a compact unit that can be easily stored and transported between facilities or rooms. Patients are given instructions to do exercises away from the rehabilitation facility, creating the need for a unit that is lightweight, foldable and easy to transport to and from the facility in the back of a minivan or car by one person.

What is needed is a lightweight, easily portable device that can be made wide enough to fit over wheel chairs or treadmills yet can made narrow enough to roll through a standard doorway. The unit must be light enough that it can easily roll on smooth floors without momentum effects overpowering the patient. It must be compact when stored yet stable and safe when fully assembled. It should be easy to assemble and disassemble by one person and be light enough to be carried by hand. It also needs to fail-safe when raising or lowering the patient to insure that it is impossible to drop a patient during use of the equipment.

BRIEF SUMMARY OF THE INVENTION

This invention provides an apparatus that can carry the partial weight of a patient during rehabilitation while walking on a treadmill or while walking on a floor with the device alone. The device is structurally strong enough to lift a patient yet light enough to be carried by one person. The invention folds to a smaller size for storage and transport and can be folded or unfolded by one person.

The invention can be used as a partial weight bearing walker due to its low mass and its minimal momentum effects. The device has wheels that can lock as a brake for use when lifting a patient out of a wheelchair or for use over a treadmill. The wheels can be locked to roll in one direction only for added stability when used as a suspension walker alone. The invention has a winch lifting system for lifting the patient to a standing position and for adjusting the amount of weight the patient bears on his/her legs. The preferred embodiment of the invention has a centrifugally activated failsafe mechanism that automatically stops the fall of the patient due to winch or rope failure or operator error while operating the winch. The device is also width adjustable and can be widened or narrowed to fit over treadmills or wheelchairs or through narrow doorways.

DETAILED DESCRIPTION OF THE INVENTION

Figure 1:
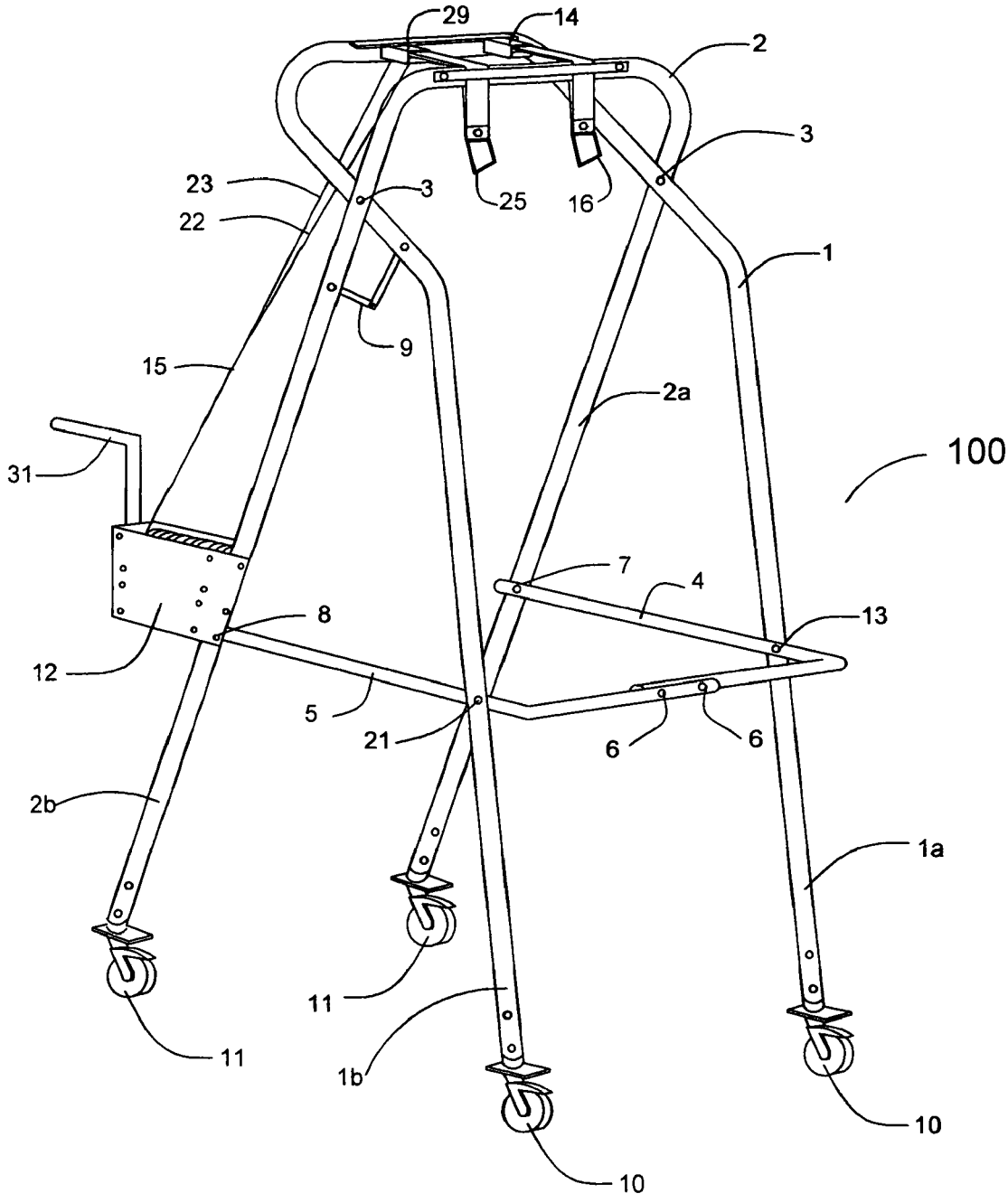
FIG. 1 is an overall view of the partial weight bearing suspension walker.

FIG. 1 shows a preferred embodiment of the weight bearing suspension walker 100. The forward frame 1 is pivotally attached to rear frame 2 with fasteners such as bolts at pivoting point 3. Forward frame 1 and rear frame 2 may also be pivotally attached with ball and socket joints, rods and clevis pins or other means such as are known in the arts to attach frames, tubing or bars in such a manner so to allow them to pivot in the same plane. Forward frame 1 has large diameter braking casters 10 attached to the bottom ends of each leg 1*a*, 1*b* of frame 1. The braking casters 10 swivel and can be braked to stop all rolling movement of the invention. Rear frame 2 has large diameter directional casters 11 attached to the bottom ends of each leg 2*a*, 2*b* of rear frame 2. The directional casters 11 swivel and can be locked in any steering direction compared to frame 2. Both braking casters 11 and directional casters 12 are attached to smaller diameter tubing that slides into forward frame 1 and rear frame 2, respectively. The directional casters 11 and braking casters 10 are interchangeable and may be attached to forward frame 1 and rear frame 2 in different combinations as required for the patients use in alternate embodiments of the invention. Casters 10 and 11 can be raised or lowered by sliding the small diameter tubing into or out of forward frame 1 and rear frame 2 and then attaching by bolts or pins in place. Forward frame 1 and rear frame 2 are preferred to be made from flexible large diameter anodized aluminum tubing although other materials and shapes may be used.

Figure 3:
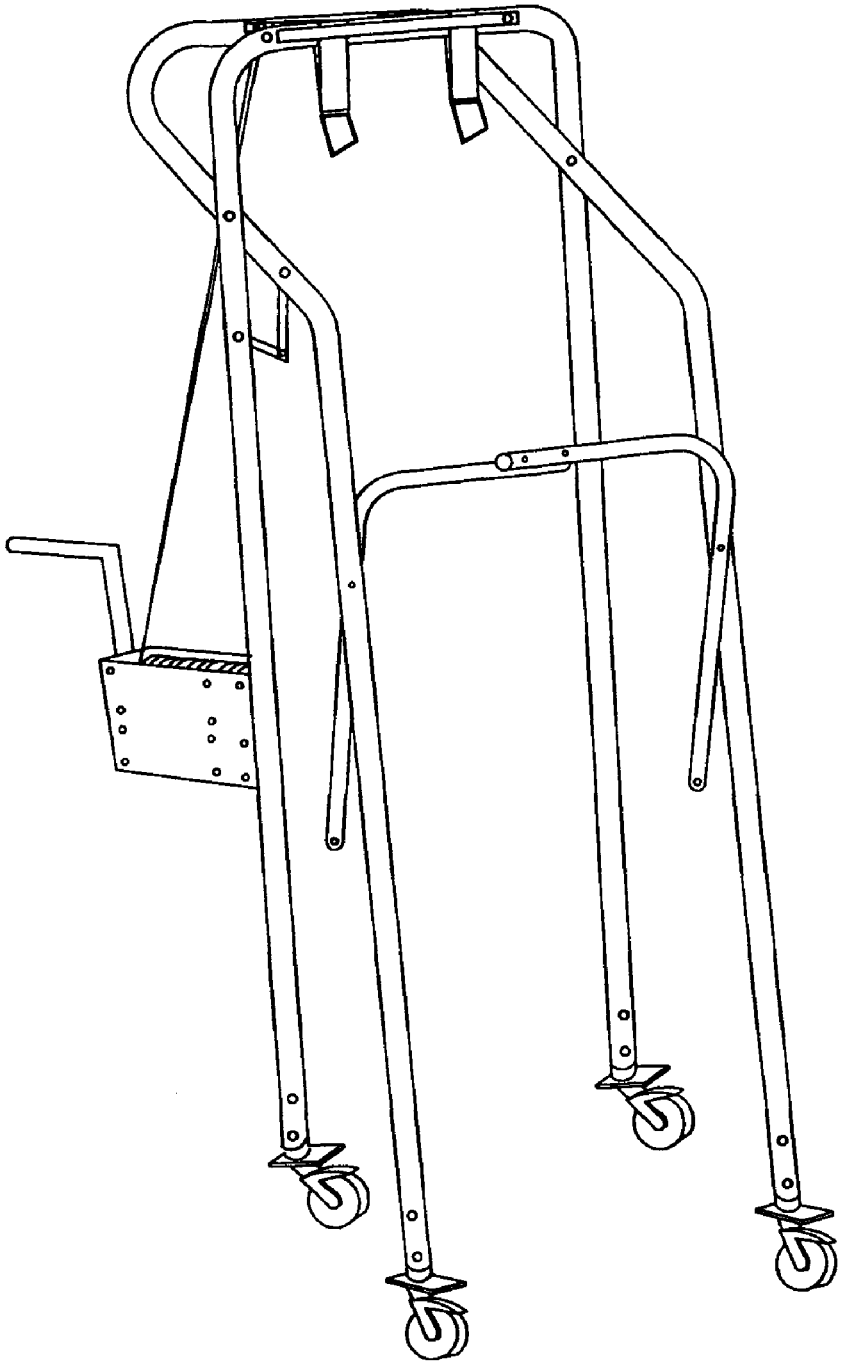
FIG. 3 is an overall view of the partially folded partial weight bearing suspension walker.

Forward frame 1 can be pivotally attached to left lower frame 4 at left lower pivot joint 13 with bolts as shown in FIG. 1. Forward frame 1 can be pivotally attached to right lower frame 5 at right lower pivot joint 21 with bolts. Both left lower frame 4 and right lower frame 5 may be pivotally attached to forward frame 1. Left lower frame 4 and right lower frame 5 are attached to the lower portion of rear frame 2 with quick release pins as are known in the art, at attachment points 8 and 7, respectively. Releasing the quick release mechanisms at attachment points 8 and 7 allow the device to fold into a much smaller space. FIG. 3 shows the invention partially folded with the frames 4 and 5 detached from the rear frame 2.

The forward portions of right lower frame 5 and left lower frame 4, as shown in FIG. 1, are attached to each other with bolts and wing nuts or threaded knobs at attachment points 6 by a plurality of holes through each frame. The plurality of holes through each frame allows the width of the invention to be adjusted to fit over a treadmill or wheelchair or through most doorways. Forward frame 1 and rear frame 2 flex in the width dimension enough so that the width of the device can be changed solely by relative adjustment of the position of right lower frame 5 to left lower frame 4. The upper portions of the forward 1 and rear frame 2 near the flat guide bar 18 and rear flat attachment bar 19 remain at a constant width that defines the narrowest possible width of the walker 100. Once the width has been adjusted by changing the position of right lower frame 5 and left lower frame 4 then the frames are locked in position with a bolt through one of the plurality of holes in both frames and a threaded knob. The relative positions may also be locked in position with other means as are known in the art such as a snap pin. Folding bar linkage 9 attaches to the upper portion of forward frame 1 and rear frame 2 just below pivoting point 3. Folding bar linkage 9 prevents forward frame 1 and rear frame 2 from expanding too far when the invention is taken from a folded position to a fully assembled standing position. Folding bar linkage 9 is designed to keep the positions of forward frame 1 and rear frame 2 in the approximate positions needed to reattach right lower frame 5 and left lower frame 4 to attachment points 8 and 7, respectively, when unfolding the invention.

Winch 12 is attached to the right lower third of rear frame 2 in FIG. 1. Winch 12 is preferred to be a hand crank model for weight savings with a safety pawl that will stop the winch movement when the operator releases the handle. Such manual winches are known in the art and are used where the danger of unintentional release of a winch is hazardous. Rope 15 is wound around winch 12 and attached to left rope 23 and right rope 22 using swages designed for rope. The ropes could also be attached with knots or by other methods as are known in the art. Though described here as rope it will be understood that cable would also work instead of rope.

Figure 2:
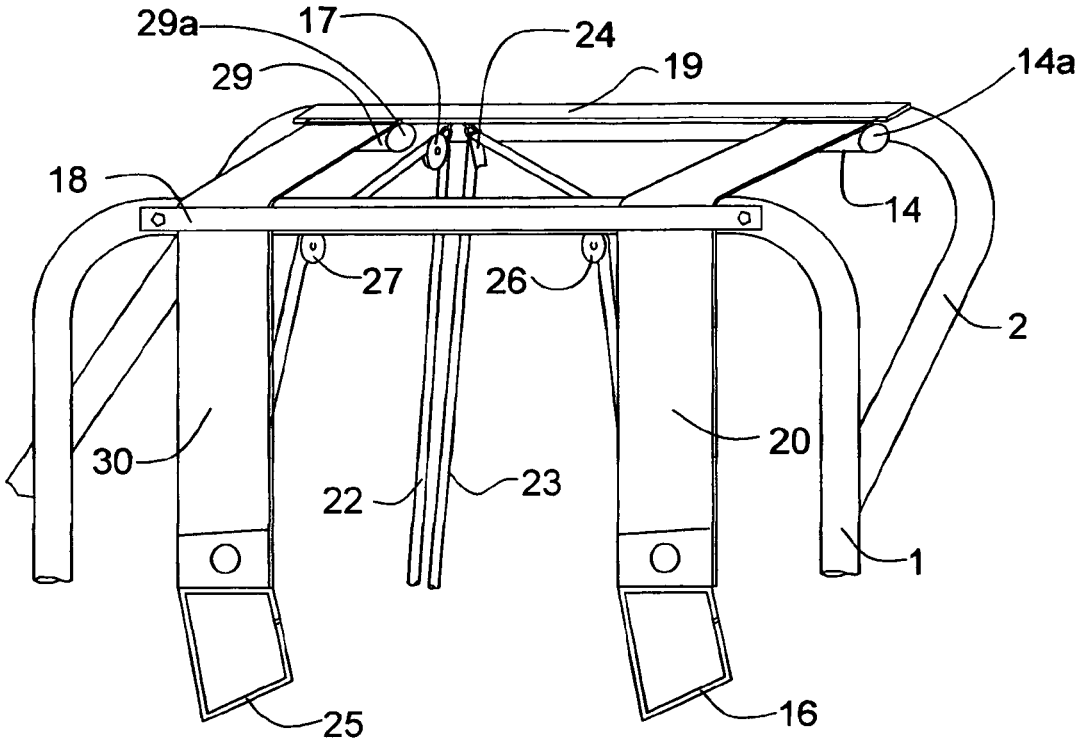
FIG. 2 is a view of the top of the partial weight bearing suspension walker.

FIG. 2 shows the preferred embodiment of the topmost portion of the invention. Left rope 23 leads through left rear pulley 24 then through left front pulley 26 and is attached to left carabineer 16. Right rope 22 leads through right rear pulley 17 then through right front pulley 27 and is attached to right carabineer 25. Left rear pulley 24 and right rear pulley 17 are attached to the right corner of rear flat bar 19. Rear flat bar 19 is attached to rear frame 2 at the topmost portion of frame 2. Left front pulley 26 and right front pulley 27 are attached to the topmost opposite corners of front frame 1. Left centrifugal seat belt mechanism 14 is mounted on the left corner of rear flat bar 19. Right centrifugal seat belt mechanism 29 is mounted on the right corner of rear flat bar 19. Left webbing 20 runs from left centrifugal seatbelt mechanism 14 over the top of forward frame 1 and between forward frame 1 and front flat bar 18. Right webbing 30 runs from right centrifugal seatbelt mechanism 29 over the top of forward frame 1 and between forward frame 1 and front flat bar 18. Front flat bar 18 is attached to the left and right corners of forward frame 1 with spacers to allow webbing to feed between forward frame 1 and front flat bar 18. The distal ends of left rope 23 and left webbing 20 are attached to carabineer 16. The distal ends of right rope 22 and right webbing 30 are attached to carabineer 25. The patient is placed in a harness, H (FIG. 4.), such as are known in the art, and attached to the invention at carabineer 16 and carabineer 25.

Cranking the winch handle 31, in FIG. 1, offloads the weight of the patient by increasing the tension in rope 15, left rope 22 and right rope 23 shown in FIG. 2. Left centrifugal seat belt mechanism 14 and right centrifugal seat belt mechanism 29 insures that if the winch 12 should fail then the patient's weight would be picked up by left webbing 20 and right webbing 30. The centrifugal seat belt mechanisms 14 and 29 normally allow belts 20 and 30 to wind onto or to be drawn off reels 14*a* and 29*a* to lower the harness H, but if the winch 12 fails the belts 20 and 30 will begin to pull out rapidly as the patient begins to fall. This rapid belt 20,30 motion will cause centrifugal force in said reels 14*a* and 29*a*, which will cause the reels 14*a* and 29*a* to stop. Centrifugal sensing mechanisms such as pawls or clutches are well known in winding a reeling and so are not shown here.

It is further pointed out that the invention is very lightweight and is easy to roll due to the efficient design. Forward frame 1 and rear frame 2 comprise the structural supports that both support the patient and lead to wheels that carry the offloaded weight to the ground. Forward frame 1 and rear frame 2 are both the structural lifting supports and the rolling base frame and eliminate the need for a separate base frame to carry the offloaded weight. The elimination of a separate base frame lowers the weight of the device, decreasing rolling friction and momentum. Decreased friction and momentum makes the invention easier to use for a physically impaired patient while undergoing gate training. This lighter weight and lower momentum make the invention available for use as a partial weight bearing walker over the floor alone or over a treadmill.

The redundant fail-safe mechanisms insure the patient's weight cannot be unintentionally released causing the patient to fall. Winch 12 has a pawl that will stop it from moving when it is released. Furthermore, centrifugal seat belt mechanisms 29 and 14 will stop downward motion when the speed of belts 20 and 30 are fast enough to engage the centrifugal clutch. The combination of the safety release on winch 12 and centrifugal seat belt mechanisms 29 and 14 insures that if the operator of the invention were to release the winch and the safety pawl were to fail then the patient's downward motion would be stopped by centrifugal seat belt mechanisms 14 and 29. Ropes 22, 23 and 15 normally carry the offloaded weight of the patient. In the unlikely failure of either rope 15, 22 or 23, then centrifugal seat belt mechanisms 14 and 29 would activate and belts 20 and 30 would carry the offloaded weight of the patient. This double redundancy is a novel feature not present in other gate training devices.

Disconnecting left lower frame 4 and right lower frame 5 from rear frame 2 allows the invention to be folded into a compact space. No tools are required to fold the invention for transport or storage or expand the invention for use. The novel use of forward frame 1 and rear frame 2 as both the patient load carrying part of the device and the base frame eliminates the need for a large and heavy base frame. The simple but unique arrangement of forward frame 1 and rear frame 2 allows the walker 100 to be folded into a small package without assembling a separate base frame. Furthermore, the walker 100 is very stable during expansion for normal use from a folded position. Folding bar linkage 9 limits the amount that forward frame 1 and rear frame 2 may spread during assembly and keeps the walker 100 in the approximate correct position for the attachment of quick release pins at attachment points 7 and 8.

The width of the invention may be expanded or contracted as needed. Left lower frame 4 and right lower frame 5 may be moved inboard or outboard and bolted with wings nuts or threaded knobs at a single attachment point 6. Forward frame 1 and rear frame 2 flex in the width dimension enough so that the width of the device can be changed solely by relative adjustment of the position of right lower frame 5 to left lower frame 4. Once the width has been adjusted by changing the position of right lower frame 5 and left lower frame 4 then the frames 4 and 5 are locked in position with a bolt through one of the plurality of holes in both frames and a threaded knob. The ability to quickly change the width of the invention at will lets the invention be used over a larger range of conditions than other devices. The invention can be expanded to fit over wide wheelchairs or treadmills. It can be placed over a wide wheelchair or bed to raise the patient into an upright position yet made narrow enough so the patient can walk through a doorway under his or her own power. This novel width adjustment feature is very important for home use where one unit would be required to do a variety of tasks during the rehabilitation of a patient.

Figure 4:
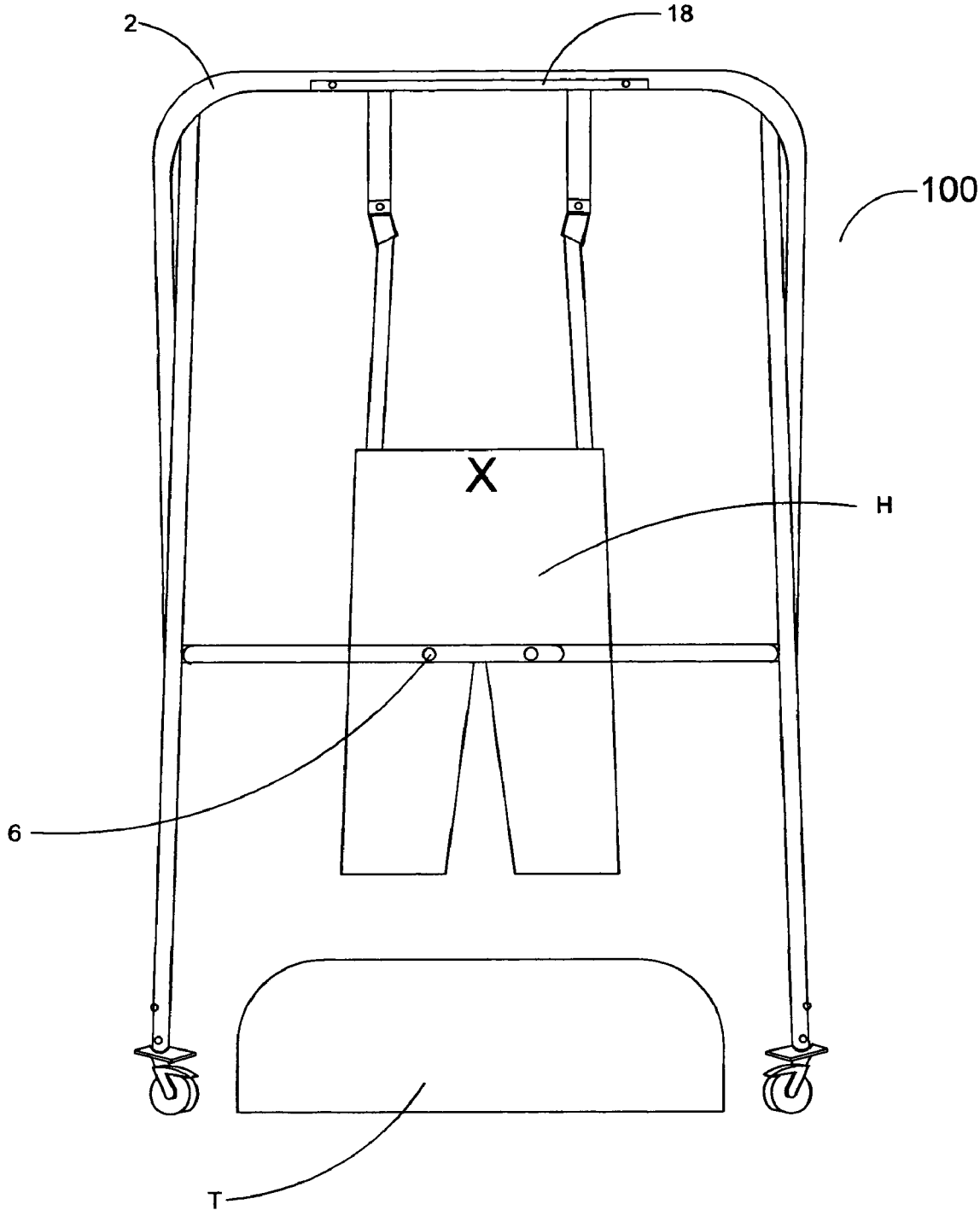
FIG. 4 shows a view of the walker in use.

FIG. 4 shows the walker 100 in use with a patient harness H attached to carabineers 16 and 25. The generally 'U' shaped forward frame 1 has been spread out such that the distance between each of the front wheels 10 is greater than the width of a treadmill T. The distance between the rear wheels 11 is also adjustable. The forward frame 1 width is adjusted by changing the attachment point 6 to achieve a wider setting of lower right 5 and left 4 frames. The forward frame 1 and rear frame 2 are sufficiently flexible to allow for the single point of adjustment. This single attachment point 6 adjustment is helpful if a patient must use a treadmill several times a day and yet may require the walker 100 to be set to the narrower setting to get through a door for example. The flexibility of the tube frames 1 and 2 allow for the use of a single point to adjust the width and yet provide a structure rigid enough to support the weight of a patient. The upper width of the walker at flat bars 18 and 19 remains constant. The center of gravity of the patient's weight, X, is below the flat bars 18 and 19 and can be adjusted using the winch 12 to raise or lower the center of gravity X.

Figure 5:
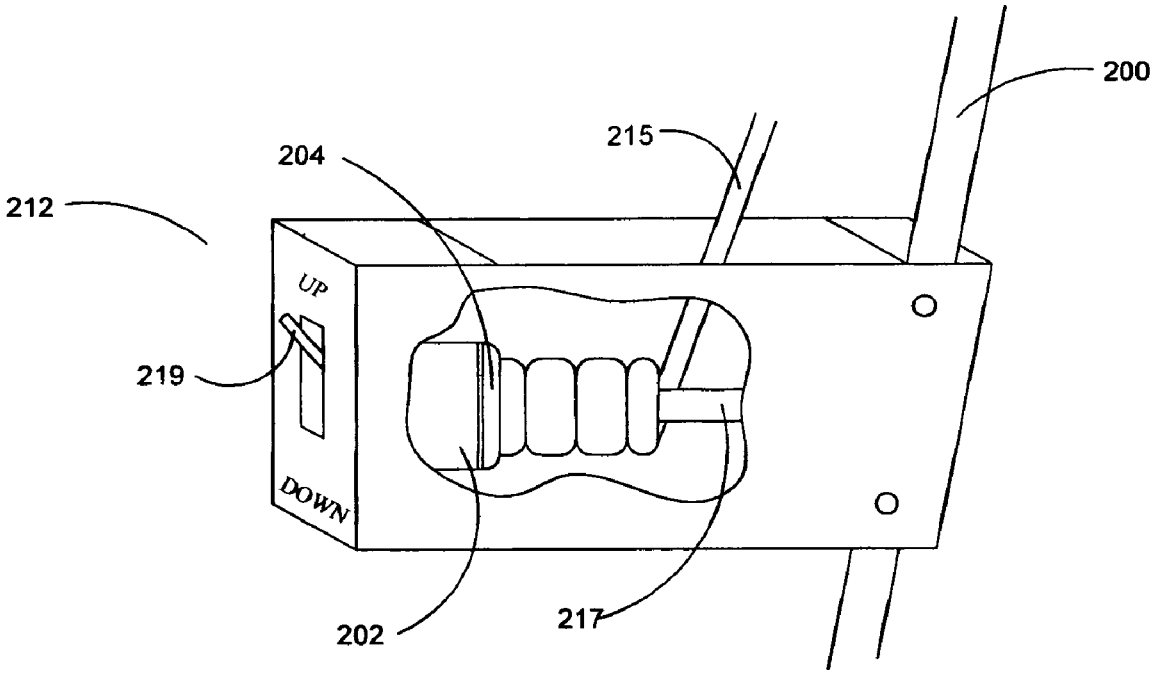
FIG. 5 shows details of a second embodiment of the device.

FIG. 5 shows the winch 212 portion of a second embodiment of the walker 200. The walker 200 is the same as the first embodiment walker 100 except that the winch 212 is motorized. A motor 202 can control the cable 215 to control the harness H position. The motor 202 can raise or lower the harness H by coiling or uncoiling cable 115 from a shaft 217. A switch 219 can control the direction of rotation of the motor 202 and shaft 217. The motor 202 can include a locking brake 204 that will prevent motion of the cable 215 when the motor 202 is not turning and anytime power is lost to the motor 202.

It will be obvious to those skilled in the art that modifications may be made to the embodiments described above without departing from the scope of the present invention as defined by the appended claims and their equivalents.

The invention claimed is:

1. A lightweight mobile apparatus, for supporting an invalid while standing and walking, said apparatus supporting said invalid by means of a harness worn by said invalid, ropes or webbing extending upward from said harness to a support point above said invalid's head, and said apparatus permitting the invalid to walk over ground or over a treadmill by means of a plurality of casters mounted on the apparatus and in contact with the ground, said apparatus consisting of:

(a) a first tubular metal frame, bent in the shape of an inverted U in a diagonal plane, said frame comprising a left leg, a right leg, and a fixed length connection between said two legs at the top, said frame having a first a swivel caster and a second swivel caster at the bottom, said first frame having a first pulley at the top and a second pulley at the top, (b) a second tubular metal frame, bent in the shape of an inverted U in a diagonal plane, said second frame comprising a left leg, a right leg, and a fixed length connection between the two said second frame legs at the top, said second frame having a third swivel caster and a fourth swivel caster at the bottom, said second frame having a left pulley at the top a and right pulley at the top, said left leg of said second frame intersecting and being pivotally connected to said left leg of said first frame, the intersection being in the shape of an X, said right leg of said second frame intersection and being pivotally connected to the said right leg of said first frame, said intersection being in the shape of an X, c) a third U shaped frame, in an approximately horizontal plane, said third U shaped frame consisting of a left side, a right side, and a connection between the two, said left side of said third frame being pivotally connected to said left leg of said first frame below said connection between said left leg of said first frame and said left leg of said second frame, and said left side of said third frame being connected to said left leg of said second frame, said connection between said left side of said third frame and said left leg of said second frame being below said connection of said left leg of said second frame to said left leg of said first frame, said right side of said third frame being pivotally connected to said right leg of said first frame below said connection between said right leg of said first frame and said right leg of said second frame, and said right side of said third frame being pivotally connected to said right leg of said second frame, said connection between said right side of said third frame and said right leg of said second frame being below the connection of said right leg of said second frame to said right leg of said first frame, the U shape of said third frame providing an opening for the entry and exit of an invalid, d) a manually operated winch, said winch having a locking mechanism that prevents rotation when the winch handle is released, said winch having a rotatable drum on which a rope is wound, e) said rope extending upward from said drum of said winch, said rope being divided into a left rope and a right rope above said drum of said winch, said left rope passing through said first pulley at said top of said first tubular metal frame, said left rope passing through said left pulley at said top of said second tubular metal frame, said left rope extending downward and ending below said left pulley of said second tubular metal frame, said left rope having at said end of said rope a means of attaching said rope to said harness whereby part of the weight of an invalid will be safely supported without the use of the invalid's arms or hands, said right rope passing through said second pulley at said top of said first tubular metal frame, said right rope passing though said right pulley at said top of said second tubular metal frame, said right rope extending downward and ending below said right pulley of said second tubular metal frame, said right rope having at its end a means of attaching it to said harness whereby part of the weight of said invalid will be safely supported without the use of said invalid's arms or hands, f) brakes on a swivel caster preventing its rotation when said brakes are engaged, said braking caster selected from a group including said first swivel caster, said second swivel caster, said third swivel caster and said fourth swivel caster, g) a swivel caster with a directional lock, said directionally locking caster selected from a group including said first swivel caster, said second swivel caster, said third swivel caster and said fourth swivel caster.

2. The mobile apparatus described in claim 1, in which the invalid support includes a fail-safe support centrifugal locking belt retractor attached to said invalid support harness.

3. The mobile apparatus described in claim 1, in which the width of the base of said apparatus is adjustable by means of an adjustment of the width of said third frame, and the flexing of said first frame and said second frame.

4. The mobile apparatus described in claim 1, in which the height of said apparatus is adjustable by means of an extension at the bottom of each of said four legs, said four casters being mounted on said four extensions.

5. A mobile apparatus as described in claim 1, in which said frame one is of aluminum alloy, and in which said frame two is aluminum alloy.

* * * * *